US009155674B2

(12) United States Patent
Kim

(10) Patent No.: US 9,155,674 B2
(45) Date of Patent: Oct. 13, 2015

(54) CHAIR UTILIZING SELF-WEIGHT TRACTION

(76) Inventor: Mun Seok Kim, Gyeongsangbuk-do (KR)

( * ) Notice: Subject to any disclaimer, the term of this patent is extended or adjusted under 35 U.S.C. 154(b) by 170 days.

(21) Appl. No.: 14/112,971

(22) PCT Filed: May 17, 2012

(86) PCT No.: PCT/KR2012/003870

§ 371 (c)(1),
(2), (4) Date: Oct. 21, 2013

(87) PCT Pub. No.: WO2012/157965

PCT Pub. Date: Nov. 22, 2012

(65) Prior Publication Data

US 2014/0070573 A1 Mar. 13, 2014

(30) Foreign Application Priority Data

May 18, 2011 (KR) ..... 10-2011-0047039

(51) Int. Cl.

*A61H 1/02* (2006.01)
*A47C 7/50* (2006.01)
*A47C 9/00* (2006.01)
(Continued)

(52) U.S. Cl.

CPC ..... *A61H 1/0218* (2013.01); *A47C 1/023* (2013.01); *A47C 1/0342* (2013.01); *A47C 7/503* (2013.01); *A47C 9/002* (2013.01); *A61H 1/0229* (2013.01); *A61H 1/0292* (2013.01); *A61H 2201/0149* (2013.01); *A61H 2201/1284* (2013.01); *A61H 2201/1642* (2013.01); *A61H 2203/0493* (2013.01)

(58) Field of Classification Search

CPC ..... A61H 1/0218; A47C 7/503; A47C 9/002
USPC ..... 297/3, 466, 423.28
See application file for complete search history.

(56) References Cited

U.S. PATENT DOCUMENTS 3,286,708 A * 11/1966 Gartner ..... 601/5
3,662,747 A * 5/1972 Williams ..... 601/5
4,502,682 A * 3/1985 Miller ..... 482/144
(Continued)

FOREIGN PATENT DOCUMENTS

JP 2001-046172 2/2001
KR 1020030006191 1/2003
(Continued)

*Primary Examiner* — David R Dunn
*Assistant Examiner* — Tania Abraham
(74) *Attorney, Agent, or Firm* — IPLA P.A.; James E. Bame

(57) ABSTRACT

A chair utilizing self-weight traction consists of: a seat unit (10) which is arranged to swing about a horizontal shaft (14) installed on chair legs (12) and which has a seat plate (16) and a back plate 18; and a binding foothold (20) arranged below the seat unit (10) so as to bind a foot of a user. According to the present invention, the seat unit (10) of the chair swings backwardly about the horizontal shaft (14) using the body weight of the user, thus enabling the user to readily take a self-weight traction posture. Therefore, the user who works while seated and thus may have a high practical need for spinal stretching may simply stretch his/her spine even during work, without being restricted in time or space, leading to the effect of treating and preventing spinal disorders such as herniated lumbar disc and scoliosis caused by the long-term use of a chair.

1 Claim, 4 Drawing Sheets

(51) Int. Cl.
*A47C 1/023* (2006.01)
*A47C 1/034* (2006.01)

(56) References Cited

U.S. PATENT DOCUMENTS

| | | | | | |
|---|---|---|---|---|---|
| 4,523,582 | A * | 6/1985 | Barber | 602/36 |
| 4,531,731 | A * | 7/1985 | Law | 482/144 |
| 4,534,554 | A * | 8/1985 | Miller | 482/144 |
| 4,624,458 | A * | 11/1986 | Fendrik | 482/144 |
| 5,575,745 | A * | 11/1996 | Lin | 482/144 |
| 6,811,522 | B1 * | 11/2004 | McQuinn | 482/143 |
| 7,025,415 | B1 * | 4/2006 | Wu | 297/119 |
| 7,361,128 | B2 * | 4/2008 | Chen | 482/144 |
| 7,399,260 | B1 * | 7/2008 | Chen | 482/145 |
| 2001/0004165 | A1 * | 6/2001 | Sumner | 297/326 |
| 2003/0062750 | A1 * | 4/2003 | Walter | 297/316 |
| 2007/0161478 | A1 * | 7/2007 | Yu | 482/145 |
| 2008/0061615 | A1 * | 3/2008 | McBride et al. | 297/325 |

FOREIGN PATENT DOCUMENTS

| | | |
|---|---|---|
| KR | 1020070006508 | 1/2007 |
| KR | 1020070010485 | 1/2007 |

* cited by examiner

CHAIR UTILIZING SELF-WEIGHT TRACTION

BACKGROUND

The present invention relates to a chair utilizing self-weight traction, and more particularly, to a chair utilizing self-weight traction that is capable of treating and preventing spinal disorders such as herniated lumbar disc and scoliosis caused by the long-term use of a chair.

BACKGROUND ART

As the automation on work using computers becomes generalized, recently, many workers suffer from their mental labor, not from their physical labor, and further, as their sitting time is increased, their spinal muscles become weak or their spine is pressed to frequently cause spinal disorders such as herniated lumbar disc and scoliosis, from which serious social problems occur.

So as to treat and prevent such spinal disorders, accordingly, regular and appropriate exercises have been recommended by lots of health professionals, but many workers actually do not have enough time to exercise due to their busy work. Therefore, spinal stretching machines should be developed and proposed to easily perform spinal muscle strengthening and spinal stretching indoors.

One of conventional spinal stretching machines is disclosed in Korean Patent Laid-Open Application No. 10-2010-0115035 which relates to a mat to which a function of an inversion table as a general exercise machine is added. In this case, a user's feet are fixed if necessary, and the mat is rotated up and down to an arbitrary height, thereby providing self weight traction effects, that is, repeating the release and tension of the muscles connected to the neck, waist, hip and legs to improve the user's muscle strength, extending and strengthening the neck bones, spinal discs, and leg joints to basically treat and prevent spinal disorders and to provide health promotion.

Further, another conventional spinal stretching machine is disclosed in Korean Utility Model Registration No. 20-0410953 wherein a user's legs are raised upwardly and his/her head is oriented downward in the state where his/her feet are inserted into a grasping roll, thereby doing inversion, so that blood flow inversion circulation is performed to provide exercising effects inversely circulating blood and snake-shaped repeated swing exercise along the spine and cervical vertebrae is performed to decrease the fatigue of the spinal joints and muscles and to relax the tense muscles and joints through the extension and release.

However, the conventional spinal stretching machines have been proposed to prevent the physical diseases caused by the compression of the spine during daily activities, but it is actually impossible to have easy access to them, which undesirably causes the restriction in use.

That is, their structure is very complicated, convenient in use, and bulky, which give many problems in occupying their installation space, and accordingly, they are restrictedly installed in houses or fitness centers, so that when users who work while being seated and thus need their spinal stretching make use of the conventional spinal stretching machines, unfortunately, many limitations in time and space occur.

DISCLOSURE

Summary of the Invention

Accordingly, the present invention has been made in view of the above-mentioned problems occurring in the prior art, and it is an object of the present invention to provide a chair utilizing self-weight traction that is capable of allowing users who work while being seated and thus need their spinal stretching to simply stretch their spine even during their work, without having any restriction in time or space, thereby leading to the effects of treating and preventing spinal disorders such as herniated lumbar disc and scoliosis caused by the long-term use of a chair.

To accomplish the above object, according to the present invention, there is provided a chair utilizing self-weight traction including: a seat unit adapted to swing around a horizontal shaft disposed on chair legs and having a seat plate and a back plate; and a binding foothold disposed in front of the seat unit to restrict a user's feet.

According to the present invention, preferably, the seat unit has a guide rail mounted on the underside thereof in such a manner as to be moved forward and backward and is fixed in position through a fastening means such as an elastic piece, bolt, pin or the like.

According to the present invention, preferably, the binding foothold includes a foothold, a fixing binder mounted over the foothold to restrict the top side of the user's foot, a moving binder mounted rotatably on the foothold to pressurize the back portion of the angle, and a locking part adapted to apply/release the pressurizing force of the moving binder.

According to the present invention, preferably, the locking part includes a fixing bar mounted on the foothold, a moving bar mounted at a location corresponding to the fixing bar and having one end coupled to the fixing bar by means of a hinge and the other end on which the moving binder is located, a stop ring adapted to insert the fixing bar and the moving bar thereinto and to apply an elastic force in the direction separated from the hinge by means of a spring, and a lever adapted to pressurize the spring and to release the elastic force of the stop ring.

According to the present invention, preferably, the binding foothold is coupled to the seat unit by means of a hinge in such a manner as to be foldable.

Advantageous Effects

According to the present invention, the chair utilizing self-weight traction can be configured wherein the seat unit swings backward around the horizontal shaft by the user's body weight, thus enabling him/her to readily take a self-weight traction posture, so that users who work while seated and thus need their spinal stretching can simply stretch their spine even during their work, without having any restriction in time or space, thereby leading to the effects of treating and preventing spinal disorders such as herniated lumbar disc and scoliosis caused by the long-term use of a chair.

DETAILED DESCRIPTION OF THE INVENTION

Figure 1:
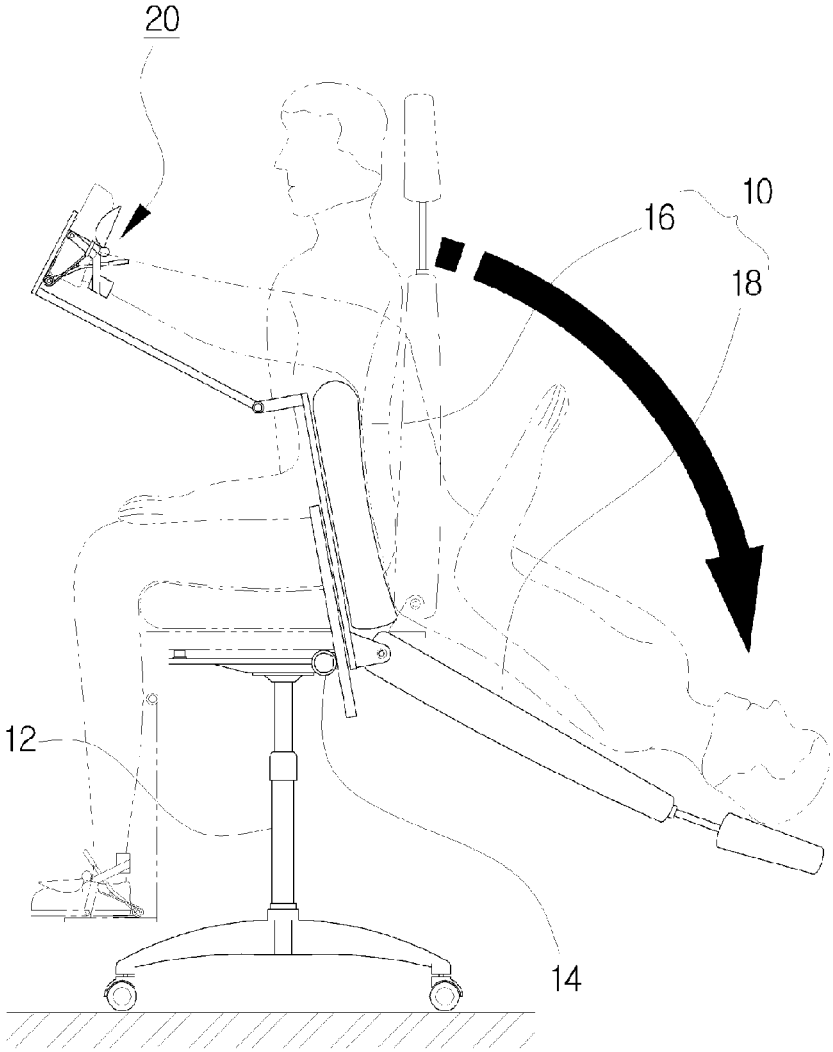
FIG. 1 is a side view showing the whole structure of a chair utilizing self-weight traction according to the present invention.

Hereinafter, an explanation on a chair utilizing self-weight traction according to the present invention will be in detail given with reference to the attached drawings.

The present invention relates to a chair utilizing self-weight traction, and according to the present invention, the chair utilizing self-weight traction largely includes a seat unit 10 and a binding foothold 20, so that a user who works while being seated and thus needs spinal stretching can simply stretch his/her spine even during his/her work, without having any restriction in time or space, thereby leading to the effects of treating and preventing spinal disorders such as herniated lumbar disc and scoliosis caused by the long-term use of a chair.

According to the present invention, the seat unit 10 is adapted to swing around a horizontal shaft 14 disposed on chair legs 12 and has a seat plate 16 and a back plate 18. The seat unit 10 has a general chair with the seat plate 16 and the back plate 18 supported by means of the chair legs 12, and at this time, the chair legs 12 may be fixed by means of at least three or more legs and alternatively may be movable through the casters mounted on the lower portions of the legs.

Further, the seat unit 10 is connected to the horizontal shaft 14 disposed on the top ends of the chair legs 12 and swings backward around the horizontal shaft 14 to allow a user to readily take a self-weight traction posture while being seated, and at this time, so as to prevent the center of the user's body weight from being escaped from the center of the chair legs 12 while the seat unit 10 is swinging around the horizontal shaft 14 and thus to keep the user from falling down, the horizontal shaft 14 is desirably disposed on the center of the chair legs 12 or near the center of the chair legs 12.

On the other hand, the seat unit 10 desirably has a stop lever (not shown) mounted on the underside thereof to fasten/unfasten the seat plate 16 and the chair legs 12 to/from each other, so that while the chair utilizing self-weight traction is being used for the purpose of a chair, the seat unit 10 does not swing around the horizontal shaft 14.

Figure 2:
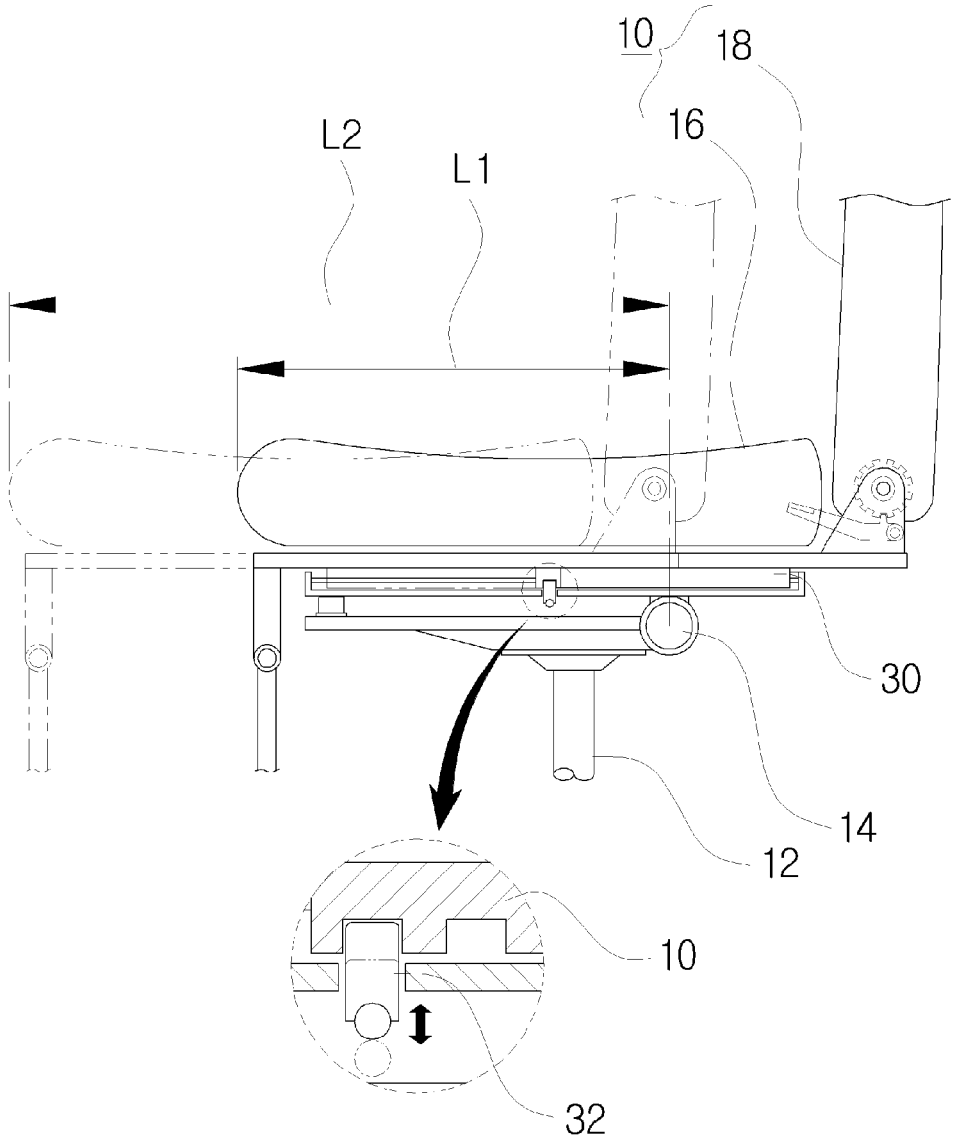
FIG. 2 is a side view showing the location moving structure of a seat unit in the chair utilizing self-weight traction according to the present invention.

At this time, the seat unit 10 has a guide rail 30 mounted on the underside thereof in such a manner as to be moved forward and backward, and the seat unit 10 is fixed in position through a fastening means 32 such as an elastic piece, bolt, pin or the like. The guide rail 30 is disposed between the seat unit 10 and the horizontal shaft 14 to allow the seat unit to be moved forward and backward through the sliding movement, and the seat unit 10 is fixed at a given position by means of the fastening means 32. The fastening means 32 is selected from any one of the elastic piece, bolt, and pin. As shown in FIG. 2, the elastic piece as the fastening means 32 is engaged with the underside of the seat plate 16 by means of the elastic force of a spring, thereby causing the location of the seat unit 10 to be fixed, and at this time, the elastic piece is locked/released by turning a lever extended from one end thereof.

Accordingly, the distance between the center of the user's body weight and the horizontal shaft 14 is adjusted by the forward and backward movements of the seat unit 10 along the guide rail 30, and as shown in FIG. 2, when the seat unit 10 is located (L1) near the horizontal shaft 14, the center of the user's body weight is moved backward to allow the user to readily take a self-weight traction posture, without any application of large force. Contrarily, when the seat unit 10 is moved forward to cause the distance separated from the horizontal shaft 14 to be extended (L2), the center of the user's body weight is moved forward so that he/she takes the balance of his/her body through the application of a force to his/her abdominal muscle and thus takes a self-weight traction posture through the backward inclination of his/her upper body, thereby learning the sense of balance and performing the stretching exercise for both of the abdominal muscle and the muscles around the abdominal muscle.

In addition, while the self-weight traction posture is being taken upon the forward movement of the seat unit 10, the distance between the user's head and the floor becomes long, and accordingly, the inclination of the seat unit 10 can be enlarged.

Figure 4:
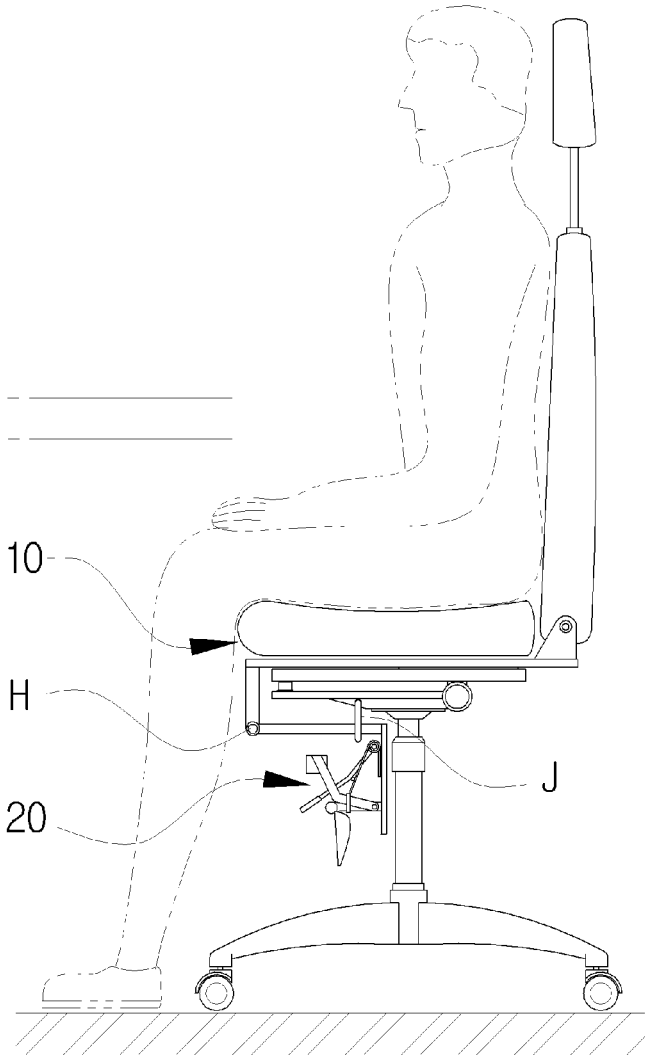
FIG. 4 is a side view showing a folding structure of the binding foothold in the chair utilizing self-weight traction according to the present invention.

Further, the binding foothold 20 is disposed in front of the seat plate 16 and restricts the user's feet. The binding foothold 20 serves to restrict the ankles so that when he/she takes the self-weight traction posture in the state of being seated on the seat unit 10, his/her lower body does not slide. If the chair utilizing self-weight traction is utilized for the purpose of a chair, the binding foothold 20 is connected to the seat unit 10 by means of a hinge H in such a manner as to be foldable below the seat unit 10 as shown in FIG. 4, which gives any trouble in use to the user. At this time, the binding foothold 20 is fastened through a fixing means J having a hook mounted thereon, so that the folded state of the binding foothold 20 is fixed.

Further, the binding foothold 20 includes a foothold 22, a fixing binder 24 mounted over the foothold 22 to restrict the top side of the user's foot, a moving binder 26 mounted rotatably on the foothold 22 to pressurize the back portion of the angle, and a locking part 40 adapted to apply/release the pressurizing force of the moving binder 26.

In this case, the fixing binder 24 and the moving binder 26 are formed of an arch-shaped plate or bar (as shown in the enlarged view of FIG. 3, the moving binder 26 is formed of an arch-shaped plate pressurizing and surrounding the back portion of the ankle), and they have a sliding prevention pad like a rubber plate mounted on the inner peripheral surface thereof so as to prevent the user's foot from sliding in the state of being brought into close contact with the user's foot. Alternatively, they have a cushion member mounted thereon in such a manner as to be tightly fixed to the shape of the user's foot and thus to enlarge the contact area with the user's foot.

Accordingly, while the user's foot is being accommodated between the foothold 22 and the fixing binder 24, the back portion of the user's ankle is restricted by the moving binder 26, and at this time, the moving binder 26 is fixed in position in the state of pressurizing the back portion of the user's ankle by means of the locking part 40.

In this case, the locking part 40 includes a fixing bar 42 mounted on the foothold 22, a moving bar 44 mounted at a location corresponding to the fixing bar 42 and having one end coupled to the fixing bar 42 by means of a hinge 44*a* and the other end on which the moving binder 26 is located, a stop ring 46 adapted to insert the fixing bar 42 and the moving bar 44 thereinto and to apply an elastic force in the direction separated from the hinge 44*a* by means of a spring 46*a*, and a lever 48 adapted to pressurize the spring 46*a* and to release the elastic force of the stop ring 46.

Figure 3:
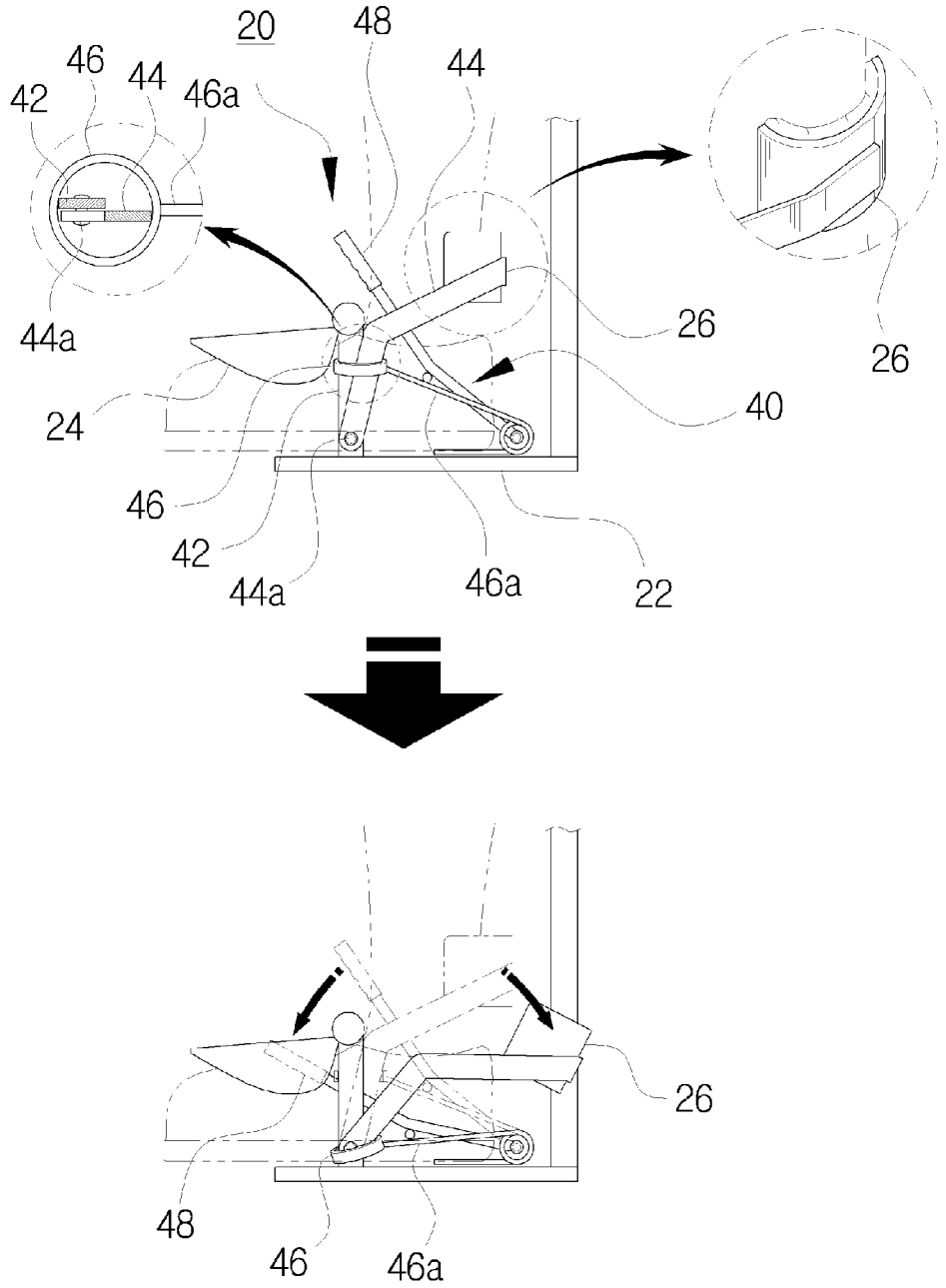
FIG. 3 is a side view showing the operating state of a binding foothold in the chair utilizing self-weight traction according to the present invention.

At this time, the fixing bar 42 and the moving bar 33 are coupled to their lower end portions by means of the hinge 44*a* in the state of being laid correspondingly on each other. As shown in FIG. 3, if the stop ring 46 is moved in the direction separated from the hinge 44*a* by means of the elastic force of the spring 46*a*, the distance between the fixing bar 42 and the moving bar 44 becomes short to allow the moving binder 26 to pressurize the back portion of the angle, and if the spring 46*a* is compressed through the manipulation of the lever 48, the stop ring 46 is moved to the location near the hinge 44*a* to allow the rotary section of the moving bar 46 to be enlarged to release the binding force of the user's foot.

On the other hand, the lever 48 is connected integrally to the spring 46*a*, and alternatively, as shown in FIG. 3, one end portion of the lever 48 is coupled to the foothold 22 by means of a hinge, so that upon the rotation around the hinge, a given section of the lever 48 pressurizes and compresses the spring 46*a*.

Accordingly, the distance between the fixing bar 42 and the moving bar 44 becomes short through the binding force of the insertion into the stop ring 46 to allow the moving binder 26 to restrict the back portion of the ankle, so that while in use, the binding force of the insertion into the stop ring 46 is continuously exerted through the elastic force of the spring 46*a*, thereby preventing the malfunction like arbitrary releasing of the binding force of the moving binder 26 while the self-weight traction posture is being taken by the user, and further the binding location of the moving binder 26 is corrected by the distance corresponding to the moving distance upon the movement of the user' foot, thereby constantly maintaining the binding force.

In operation, the user's feet are fixed to the binding foothold 20 in the state of being seated on the seat unit 10, and next, if his/her upper body is brought into close contact with the back plate 18 to move the center of his/her body weight backward around the horizontal shaft 14, the seat unit swings together with the binding foothold 20 around the horizontal shaft 14, thereby allowing him/her to simply take the self-weight traction posture.

At this time, so as to naturally take the self-weight traction posture in a stable manner, without any application of large force, the swinging angle of the seat unit 10 is preferably limited in the range between 30° and 80°, and so as to do this, the angle of the back plate 18 with respect to the seat plate 16 is preferably set in the range between 100° and 170°.

Accordingly, while the user is working in the state of being seated on the chair utilizing self-weight traction according to the present invention, he/she moves the center of his/her body weight to readily take the self-weight traction posture, so that users who work while being seated and thus need their spinal stretching can simply stretch his/her spine and improve his/her muscle strength even during work, without having any restriction in time or space.

On the other hand, so as to previously prevent the user from falling to the outside of the seat unit 10 while he/she is taking the self-weight traction posture, preferably, guide bars or handles are disposed on both ends of the seat unit 10.

While the present invention will be described with reference to the particular illustrative embodiments, it is not to be restricted by the embodiment but only by the appended claims. It is to be appreciated that those skilled in the art can change or modify the embodiments without departing from the scope and spirit of the present invention.

What is claimed is:

1. A chair utilizing self-weight traction comprising:

a seat unit (10) having a seat plate (16) and a back plate (18) and adapted to swing around a horizontal shaft (14) disposed on chair legs (12), the seat unit (10) being moved forward and backward by means of a guide rail (30) mounted on the underside thereof and being fixed in position through a fastening means (32); and a binding foothold (20) disposed in front of the seat unit (10) in such a manner as to be connected to the seat unit (10) by means of a hinge (H) and fixed in the folded state below the seat unit (10) by means of a fixing means (J) to prevent the binding foothold (20) from giving any trouble in use, while the chair utilizing self-weight traction is being used for the purpose of a chair, wherein the binding foothold (20) comprises:

a foothold (22);

a fixing binder (24) mounted over the foothold (22) to restrict the top side of the user's foot;

a moving binder (26) mounted rotatably on the foothold (22) to pressurize the back portion of the user's ankle; and a locking part (40) adapted to apply/release the pressurizing force of the moving binder (26), and the locking part (40) comprises:

a fixing bar (42) mounted on the foothold (22);

a moving bar (44) mounted at a location corresponding to the fixing bar (42) and having one end coupled to the fixing bar (42) by means of a hinge (44*a*) and the other end on which the moving binder (26) is located;

a stop ring (46) adapted to insert the fixing bar (42) and the moving bar (44) thereinto and to apply an elastic force in the direction separated from the hinge (44*a*) by means of a spring (46*a*); and a lever (48) adapted to pressurize the spring (46*a*) and to release the elastic force of the stop ring (46).

* * * * *